US006729491B2

(12) United States Patent
Morris, Jr.

(10) Patent No.: US 6,729,491 B2
(45) Date of Patent: May 4, 2004

(54) PAIL LID WITH BUILT IN TORQUING TOOL

(75) Inventor: Glenn H. Morris, Jr., Chattanooga, TN (US)

(73) Assignee: M&M Industries, Inc., Chattanooga, TN (US)

( * ) Notice: Subject to any disclaimer, the term of this patent is extended or adjusted under 35 U.S.C. 154(b) by 7 days.

(21) Appl. No.: 10/091,939

(22) Filed: Mar. 6, 2002

(65) Prior Publication Data

US 2003/0222084 A1 Dec. 4, 2003

(51) Int. Cl.[7] ..... B65D 43/26
(52) U.S. Cl. ..... 220/284; 220/212.5; 81/3.15
(58) Field of Search ..... 220/212.5, 284–286, 220/288, 304, 752, 761, 766, 768; 215/228, 302, 305, 390; 81/3.07, 3.15, 3.55

(56) References Cited

U.S. PATENT DOCUMENTS

| | | | | | |
|---|---|---|---|---|---|
| 879,516 | A | | 2/1908 | Cantwell | |
| 1,031,775 | A | | 7/1912 | Cox | |
| 1,447,320 | A | * | 3/1923 | Pickop | 220/284 |
| 1,912,969 | A | * | 6/1933 | Carvalho | 215/302 |
| 2,094,567 | A | * | 9/1937 | Barnby | 215/302 |
| 2,120,603 | A | | 6/1938 | Dreucci | |
| 2,308,217 | A | * | 1/1943 | Swanson | 215/303 |
| 2,487,274 | A | * | 11/1949 | Schaffer | 215/228 |
| 3,470,927 | A | * | 10/1969 | Craig | 220/304 |
| 3,612,338 | A | | 10/1971 | Ikman | |
| 3,945,526 | A | | 3/1976 | Robertson, Jr. | |
| 4,126,246 | A | | 11/1978 | Galer | |
| 4,399,926 | A | * | 8/1983 | Eidels-Dubovoy | 220/288 |
| 4,453,647 | A | | 6/1984 | Neat | |
| 4,644,874 | A | | 2/1987 | Kleykamp | |
| 4,730,747 | A | | 3/1988 | Schiemann | |
| 5,096,083 | A | * | 3/1992 | Shaw et al. | 220/304 |
| 5,325,175 | A | | 6/1994 | Mocker et al. | |
| 5,443,175 | A | | 8/1995 | Kelly et al. | |
| 5,579,932 | A | | 12/1996 | Drozd et al. | |
| 5,791,505 | A | | 8/1998 | Gilliland | |
| 6,056,143 | A | * | 5/2000 | Stolzman | 220/284 |
| 6,170,691 | B1 | * | 1/2001 | Morris et al. | 220/304 |
| 6,237,797 | B1 | * | 5/2001 | Hurford | 220/212.5 |
| 2001/0025865 | A1 | * | 10/2001 | Bravo et al. | 215/305 |

* cited by examiner

*Primary Examiner*—Nathan J. Newhouse
(74) *Attorney, Agent, or Firm*—Stephen J. Stark; Miller & Martin PLLC

(57) ABSTRACT

A lid for use with an open top container threadably engages with the open head container to secure the lid to the container. A seal is located between tapered surfaces of the lid and the container member such that compression of the seal occurs gradually as the lid is threadably secured onto the container member. The lid is equipped with a torquing tool which pivots at along a ridge at the edge of the lid. In a stored configuration, the torquing tool has a handle which is at least partially contained within a chamber in the lid. A base of the torquing tool has a top surface which is coplanar with a top surface of a portion the lid in the stored configuration. To utilize the torquing tool, the handle is rotated about the pivot, to an extended position. The handle may then assist an operator in twisting the lid relative to the container member.

18 Claims, 4 Drawing Sheets

PAIL LID WITH BUILT IN TORQUING TOOL

BACKGROUND OF THE INVENTION

The present invention relates to lids for use with pails and more specifically to a pail lid or cover having a built-in torquing tool.

Various pails or barrels and similar containers and cover, or lid, assemblies are known in the art. Some pails are utilized to store chemicals or other solutions. Other pails are utilized to store dry goods.

When storing solutions, it is often important to provide a seal between a lid and the wall of the container to prevent spilling and leaking of the solution from the container past the lid. Some stored solutions may have a corrosive effect, or discolor some surfaces upon contact if the solution were to inadvertently spill from a storage container. U.S. Pat. Nos. 4,494,674 and 3,897,874 disclose seals between a container member and a lid.

U.S. Pat. Nos. 6,170,691 and 6,006,942, owned by the owner of the present application, the entire contents of which are hereby incorporated by reference, address a need in the industry to reduce the amount of strength required to close a lid onto an open lid container by providing a seal which is gradually compressed as a lid is rotatably threaded onto the container member. While these designs are an improvement over the prior art, there remains a need to assist those individuals lacking sufficient strength to open and close lids on containers.

Specifically, if a very strong person applies a large amount of torque to a lid to secure the lid to the container, it may be very difficult for a weaker person to remove the lid from the container. Furthermore, if a lid is not attached to a particular container, even with the improved gradual sealing technique disclosed in the aforesaid other patents of the owner of the present application, it may still be difficult for some weak people to apply a specific amount of torque to the lid to significantly reduce the likelihood of spillage should a sudden surge in pressure occur within the closed container, such as may occur if the container is dropped onto a hard surface. Accordingly, a need exists to provide a means which assists a person in applying torque to a lid.

A number of mechanisms have been devised over the years to provide a handle, or a torquing tool for use with lids, caps, or tops. Specifically, U.S. Pat. No. 879,516 shows a hot water bottle with a handle 15 that pivots relative to an extension 13 which is connected to head 11. While this design may be suitable for the application provided in the '516 patent, the use of an extension with pail lids is not convenient nor desirable. The inclusion of an extension would increase the cost of materials in the lid and would affect the way pails and pail lids are stored. Improvements may be made over this design.

U.S. Pat. No. 1,031,775 shows another top, or screw stopper, for use with cans, drums, jars bottles and other vessels. A handle slidably extends from a slot in the top of the stopper to provide a torquing aid for a user. While a number of advantages are obtained from this design, the construction utilizing the teachings of this design in the form of a pail lid would likely require significant labor and complexity. Accordingly, improvements may be made over this design as well.

Various pivoting handle designs have been utilized for particular containers. U.S. Pat. No. 4,730,747 shows a handle on a gas can lid which pivots from about the centerline of the lid. U.S. Pat. No. 3,945,526 shows another construction where a handle pivots at the centerline of a cap which may be utilized on a nail polish bottle. U.S. Pat. Nos. 2,120,603 and 2,308,217 show somewhat similar constructions for a jar cap having a handle which pivots from an extension located on a top surface of the lid, about half way from the edge of the cap to the center of the cap.

Thus, although numerous attempts have been made to provide a torquing tool as a portion of a cap, none of the prior art construction are believed to be particularly suited for pail covers with the exception of U.S. Pat. No. 4,126,246 with gripping structure formed into a top surface of the lid and U.S. Pat. No. 4,453,647 having a recessed portion in the lid for receiving a paint stir stick. While these designs may be acceptable in some applications, they are not practicable when it is necessary or important to maintain a seal between a lid and a container and for other reasons.

SUMMARY OF THE INVENTION

Consequently, it is an object of the present invention to provide an open top container and lid assembly with the lid having a torquing tool available to assist a user in the attachment and/or detachment of the lid from the container.

It is another object of the present invention to provide a torquing tool which pivots about a pivot point on a ridge of the lid.

Another object of the present invention is to provide a torquing tool which may be stored in an unobstrusive manner when not in use.

Yet another object of the present invention is to provide a torquing tool which does not interfere with the ability of multiple pails with lids to stack on top of one another.

Accordingly, the present invention provides a lid for an open end container. The lid preferably threadably engages with the open end container to secure the lid to the container and has a seal located between tapered surfaces of the lid and the container member such that compression of the seal occurs gradually as the lid is threadably secured onto the container member.

The lid has a torquing tool which pivots at a ridge at the edge of the lid. In a stored configuration, the torquing tool has a handle which is at least partially contained within a depression or chamber in the lid. A base of the torquing tool has a top surface which is coplanar with a top surface of the lid in the stored configuration. To utilize the torquing tool, the handle is rotated about the pivot, to an extended position. The handle may then assist an operator in twisting the lid relative to the container member.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
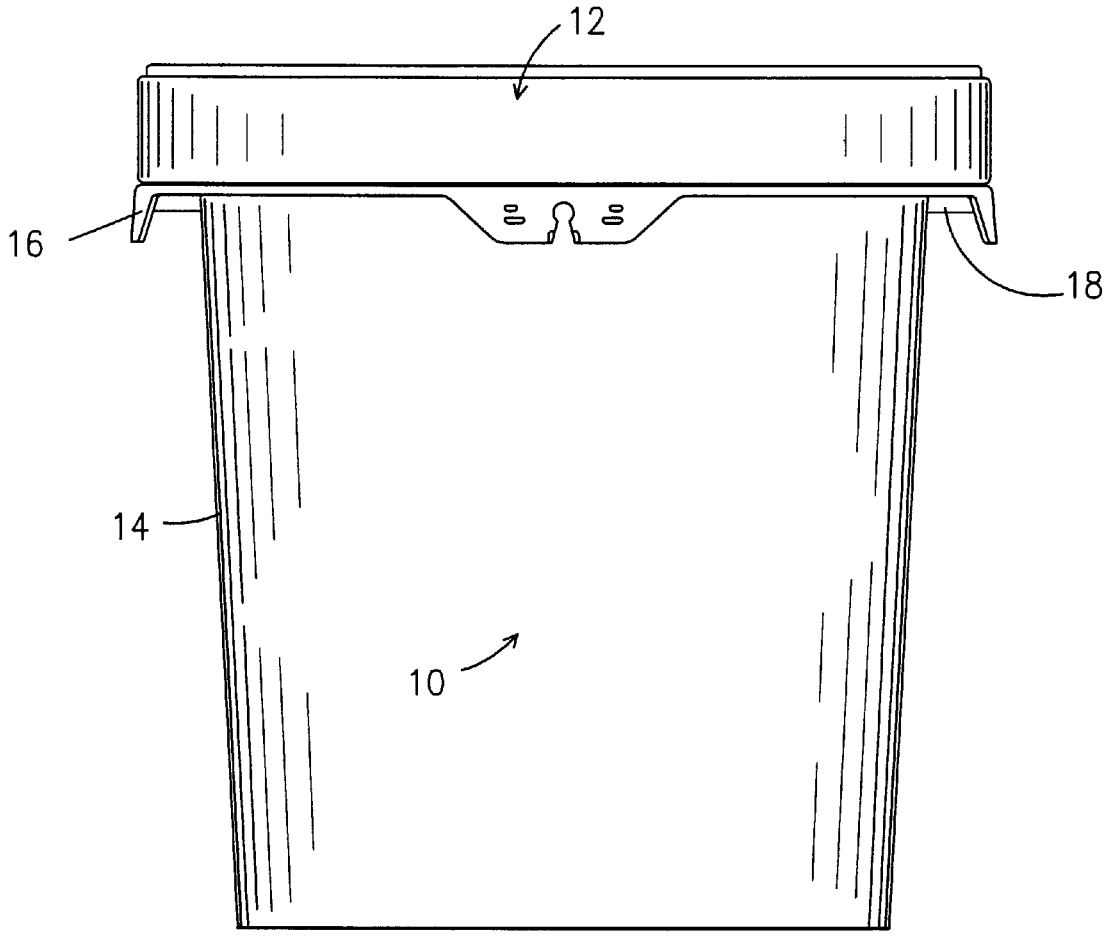
FIG. 1 is a side elevational view showing a lid secured to a container member.

FIG. 1 shows a presently preferred open top container member 10 with a lid 12 threadably mounted thereon. The container member and lid 12 are preferably formed of molded plastic, such as by injection molding. The container member 10 may be any suitable size, with a five gallon container member being illustrated in the preferred embodiment. The container member 10 includes a main body portion 14 and an annular skirt member 16 spaced from and encircling the main body portion 14 adjacent the open end of the container member 10. A plurality of reinforcing webs 18 are illustrated between the main body portion 14 and the annular skirt member 16. The webs 18 may extend radially outwardly from the main body portion 14, or may extend outwardly from the main body portion 14 at an angle inclined with respect to the radial direction. Alternatively, the plurality of webs 18 may be replaced by a single disk encircling the main body portion 14, and interconnecting the main body portion 14 with the annular skirt member 16. In the preferred embodiment, eight reinforcing webs 18 are utilized spaced equidistantly around the circumference of the main body portion 14.

Figure 2:
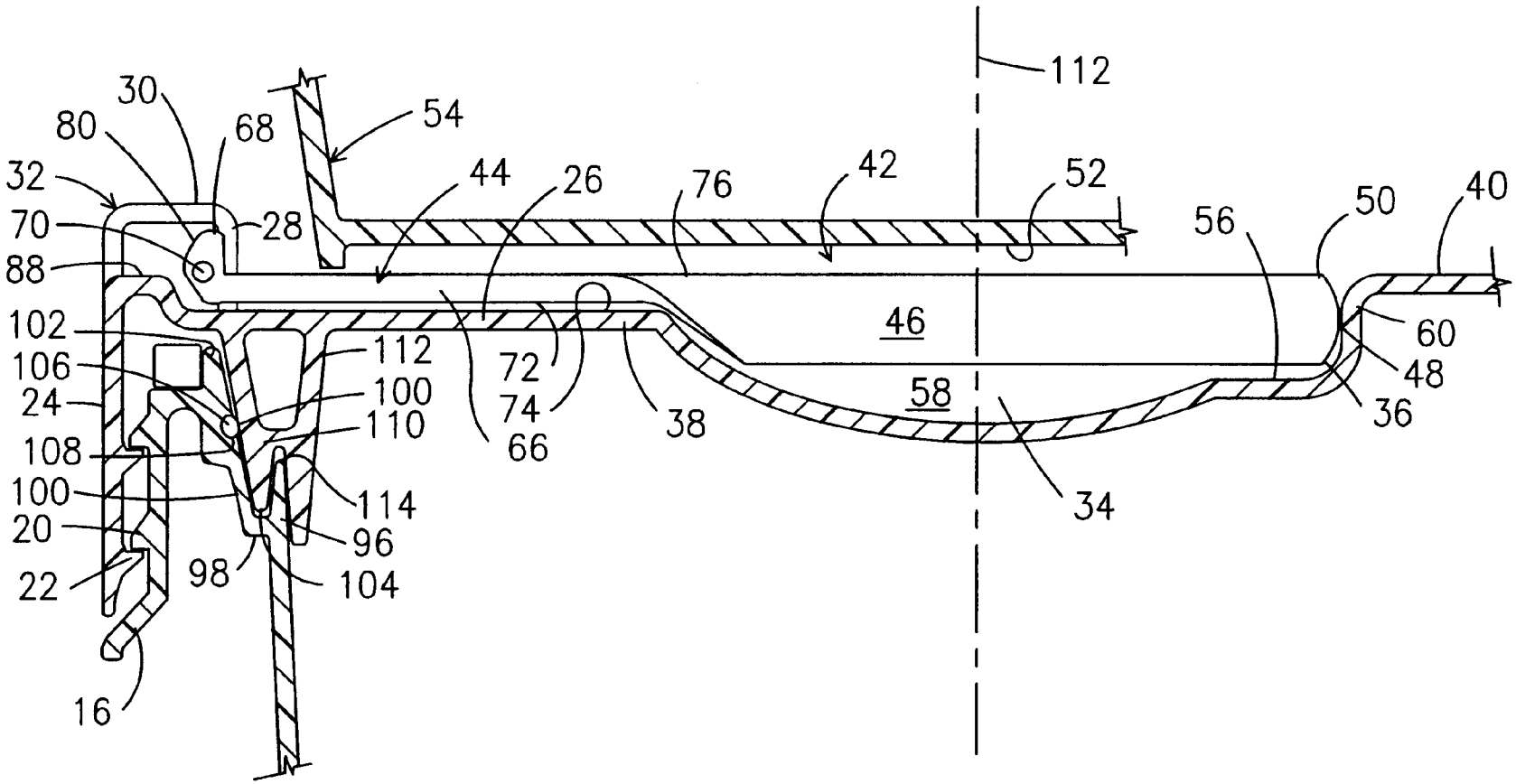
FIG. 2 is a partial side sectional view showing the lid secured to the container member with a seal sandwiched therebetween, and a torquing tool connected to the lid.

The outer surface of the annular skirt member 16 includes outwardly directed threads 20, as shown in FIG. 2. The lid includes inwardly directed threads 22 located on an interior surface of an outermost wall 24 of the lid. The inwardly directed threads 22 are threadably engageable with the outwardly directed threads 20 to secure the lid 12 to the container member 10 by twisting either the lid 12 or the container member 10 relative to the other about a twisting axis 112.

Tapered threads are shown in the embodiment illustrated due to their fluid sealing characteristics. However, it should be understood that various types of threads may be utilized, such as straight or square threads without departing from the spirit of the present invention. Furthermore, although right-hand threads have been shown in the Figures, it should be apparent that in some applications, the use of left-hand threads and/or multiple parallel threads may be utilized.

The details of the construction of the lid 12 are illustrated in FIG. 2, where it will be seen that the lid 12 comprises a disk member 26, to which a first upwardly extending wall member 28 is attached. The first upwardly extending wall member 28 substantially encircles the disk member 26. A middle wall member 30 is attached to the top of the first upwardly extending wall member 28 and extends radially outwardly therefrom. Extending downwardly from the middle wall member 30 is the outermost wall 24. Together with the first upwardly extending wall member 28, the middle wall member 30 and the outermost wall 24 form a ridge 32 having an inverted U-shape at the top portion of the first upwardly extending wall member 28 and the top portion of the outermost wall 24. The ridge 32 substantially encircles the disk member 26.

Figure 4:
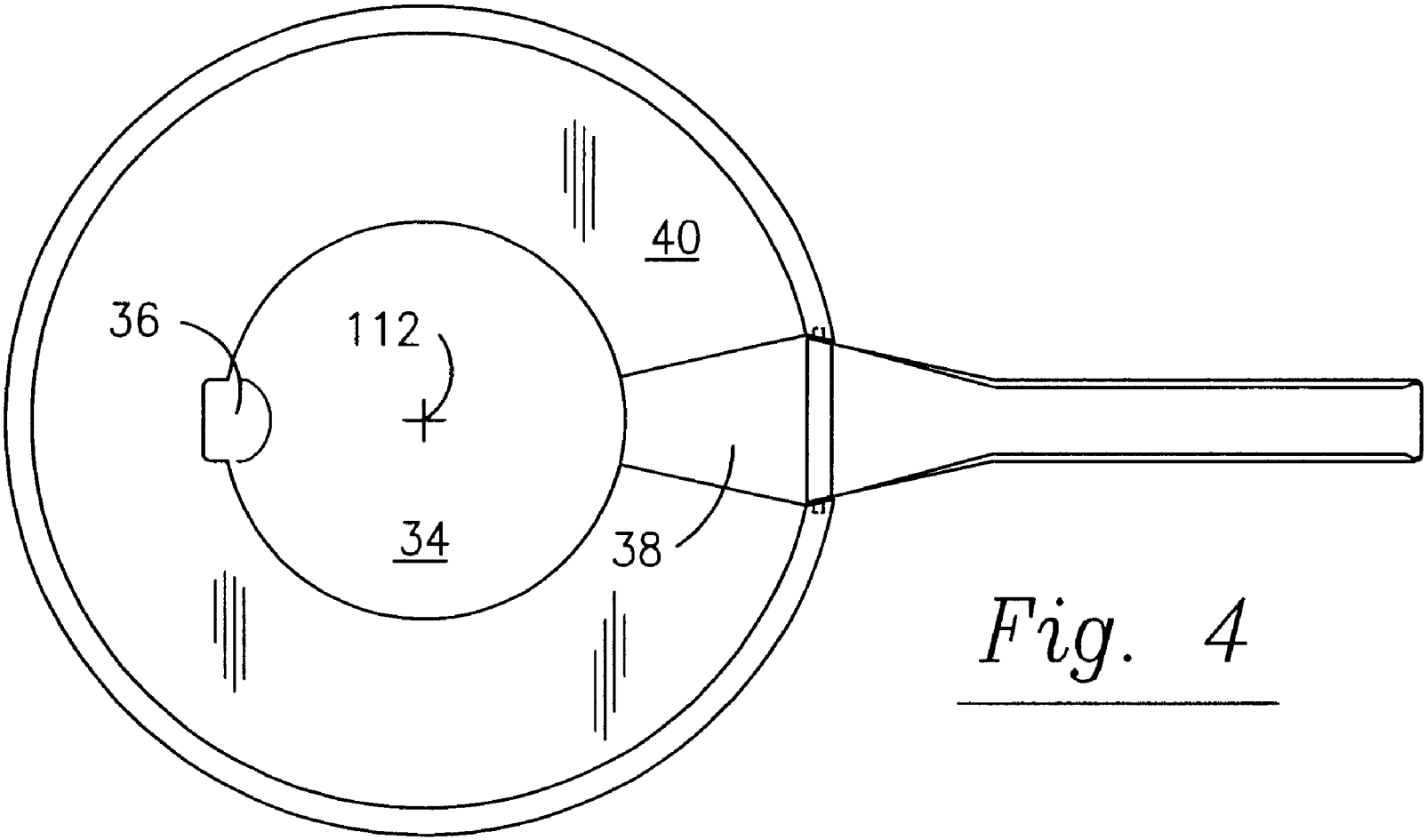
FIG. 4 is a top plan view of the lid with the torquing tool in an extended configuration.

The ridge 32 surrounds or encircles a perimeter of the disk member 26. As shown in FIGS. 2 and 4, the disk member 26 has a depression in the form of a chamber 34 connected to a well 36 and a slot 38 recessed relative to top surface 40. The chamber 34, the well 36 and the slot 38 preferably join one another below the top surface 40 of the disk member 26 and are symetrical about a torquing took axis 90. The top surface 40 of the disk member 26 is preferably substantially planar. The chamber 34, well 36 and slot 38 extend downwardly from the top surface 40. The disk member 26 encircles the chamber 34.

Figure 3:
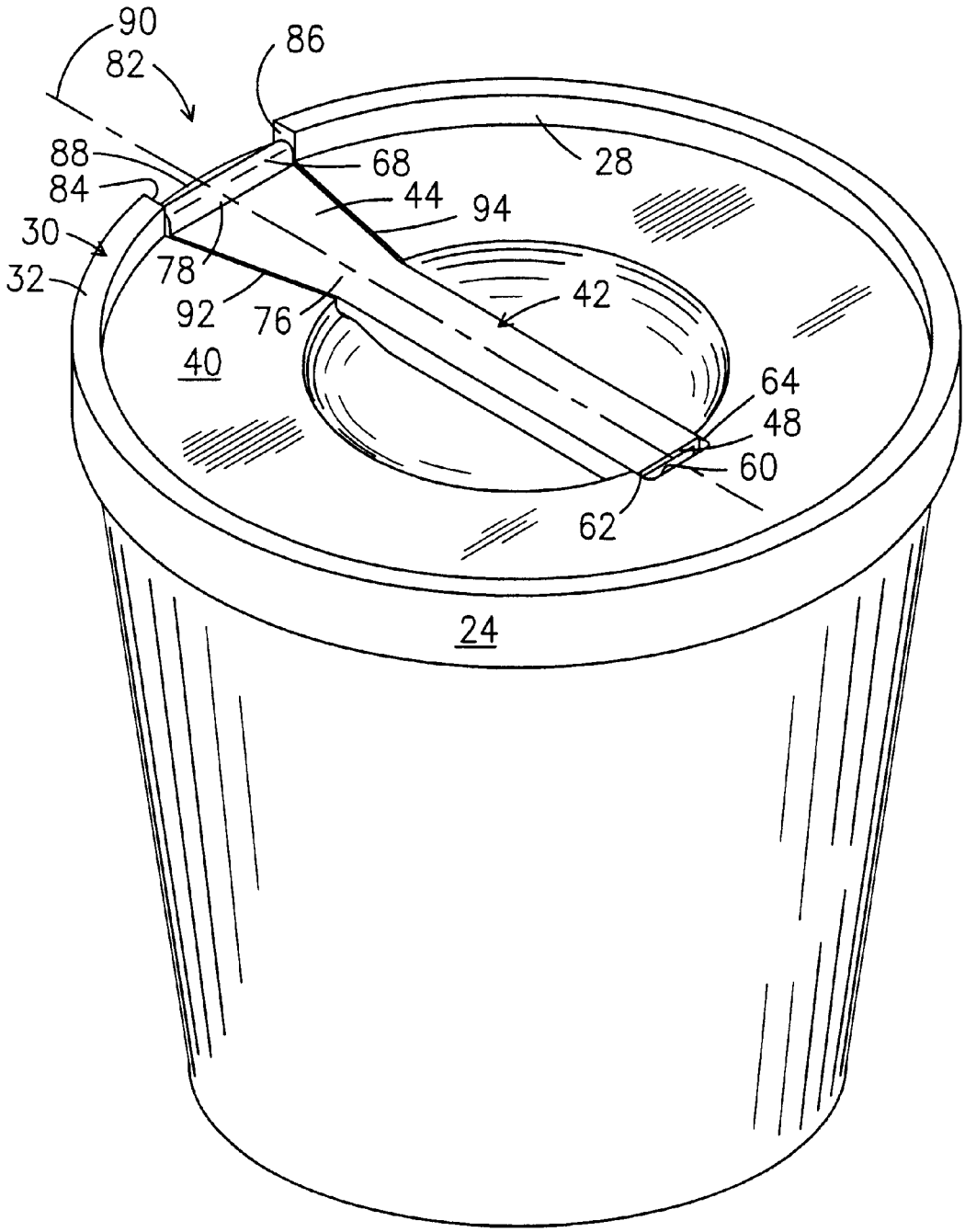
FIG. 3 is a top perspective view of the lid on a container with the torquing member in a stored configuration.

The lid 12 also has a torquing tool 42 which has a base 44 connected to a handle 46. The handle 46 may be cylindrical as illustrated to provide comfort when utilized. When not in use, it is anticipated that the torquing tool 42 will be placed in a stored configuration as illustrated in FIG. 3. A distal end 48 of the handle 46 is at least partially contained within well 36. It is preferably for well 36 to contain a large percentage, if not all, of the distal end 48 of the handle 46 to assist in preventing the handle 46 from interfering with stacking of multiple containers 10 with lids 12 attached. As shown in FIG. 2, the handle 46 has a top portion 50 which is higher than the top surface 40 of the disk member 26. Nevertheless, the bottom 52 of a stacked pail 54 is not interfered with, such as not contacted being by the handle 46. The handle 46 preferably contacts a resting surface 56 of the well 46. However, depending on the configuration of the slot 36 and chamber 34, the handle 46 may not contact the resting surface 56 in all embodiments.

The well 36 preferably has a configuration that cooperates with the distal end 48 of the handle 46 to accept the handle 46 within the well 36 without much space between well walls 60,62,64 and the handle 46. The well wall 60 is preferably substantially parallel with the distal end 48 of the handle 46. The well walls 62,64 are preferably curved and meet and/or form the resting surface 56.

The chamber 34 extends a distance below the handle 46 to provide a space 58 for an operator to grasp the handle 46 to pivot the torquing tool 42 to an operating position shown in FIG. 4. The chamber 34 may be concave as illustrated, or may have other constructions.

The base 44 of the torquing tool 42 is at least partially received in slot 38. The base has a leg 66 which connects with handle 46 and an abutment 68 which provides or connects to pivot 70. In the embodiment illustrated, the leg 66 is received within the slot so that a bottom surface 72 of the leg contacts, or nearly contacts, a floor surface 74 of the slot 38. An upper surface 76 of the leg is preferably coplanar with, or located below, or located slightly above, the top surface 40 of the disk member 26 when the torquing tool 42 is in a stored configuration. The upper surface 76 is also parallel to the top surface 40 of the disk member 26. The base 44 may terminate within the slot 38 or may extend into the chamber 34 in the stored configuration as illustrated. The upper surface 76 does not interfere with stacking of multiple containers 10 with lids 12 when the torquing tool 42 is in the stored configuration.

The abutment 68 is at least partially received within the ridge 32 in the stored configuration. As illustrated in FIG. 3, the abutment 68 contains an abutment wall 78 which forms a substantially continuous wall with the upwardly extending wall member 28 of the ridge 30 in the stored configuration. The pivot 70 is obscured from view in FIG. 3, but is shown in FIG. 2 extending outwardly from abutment side 80. Abutment side 80 is located within receiver 82. Receiver 82 has receiving walls 84,86 and receiving floor 88. Receiving walls are preferably planar and angled relative to torquing tool axis 90. The angle that each of the receiving walls 84, 86 forms with the torquing tool axis 90 is preferably the same angle that leg sides 92,94 form with the torquing tool axis 90. Accordingly, when the torquing tool 42 is pivoted to an operational configuration shown in FIG. 4, the leg sides contact the receiving walls 84,86. Furthermore a portion of the top surface 76 of the leg 66 contacts the receiving floor 88. This supports the torquing tool 42 in the preferred embodiment so that the torquing tool 42 extends radially away from twisting axis 112 and is substantially parallel to the disk member 26 of the lid 12 in the operational configuration and about one hundred eighty degrees from the stored configuration.

In order to transition the torquing tool 42 from the stored configuration shown in FIG. 3 to the operational configuration shown in FIG. 4, the handle 46 is grasped by an operator and pivoted about the pivot 70 shown in FIG. 2 until the upper surface 76 of the leg 66 contacts the receiving floor 88. As the handle 46 of the torquing tool 42 is utilized to apply torque to the lid 12, the leg sides 92,94 contact the receiving walls 84,86 and provide a mechanical advantage resulting in increased torque relative to the container 10.

Although various sealing configurations could be utilized with other embodiments of container 10, the upper open end of the main body member 14 has a lower annular rim 96. A lower wall member 98 extends radially outwardly from the main body portion 14 from a position below the lower annular rim 96. An inclined or tapered wall member 100 extends ujpwardly from the lower wall member 98. The upper portion of the tapered wall member 100 forms an upper annular rim 102. Together with the lower annular rim 96, the lower wall member 98 and a portion of the tapered wall member 100 form a U-shaped channel 104. Located along the tapered wall member 100 is a seal 106 located within groove 108.

When the lid 12 is applied to the open top container member 10, the O-ring seal 106 of the container member 10 is compressed between the tapered wall member 100 of the container member 10 and the tapered wall member 110 of the lid 12 to effectively form a seal therebetween. Due to the included or tapered arrangement of at least one of the sealing surfaces, as the lid 12 is threadably tightened onto the container member 10, the tapered wall member 110 gradually contacts and begins to compress the O-ring seal 106. Further rotation and tightening of the lid 12 with respect to the container member 10 results in gradual compression of the O-ring seal 106 therebetween.

In addition to the tapered wall member 110, the lid 12 has an internal wall member 112, a lower portion of which assists in forming a notch 114, or U-shaped channel, with a bottom portion of the tapered wall member 110. The notch 114 receives the lower annular rim 96 of the container 10. The notch 114 cooperating with the lower annular rim 96 and the U-shaped channel 104 cooperating with a lower portion of the tapered wall member 110 form a tortuous path for inhibiting the passage of fluid therepast.

While the construction of the sealing mechanism withing the container 10 is very similar to that shown in applicants U.S. Pat. No. 6,170,691, it was not earlier anticipated that a torquing tool 42 would be advantageous during the initial development and production of the open ended container disclosed in that reference. Furthermore, although the lid 12 with torquing tool 42 is particularly well adapted for use with the container disclosed in that reference, the lid 12 of the present invention may be utilized with other open end container configurations.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A lid for use with an open head container, said lid comprising:

a disk member having a top surface;

a ridge extending above and at least substantially around an outer perimeter of the planar disk;

a downwardly extending outermost wall connected to the disk member and the ridge, said outermost wall having inwardly directed thread members;

a receiver at least partially located in the ridge; and a torquing tool having an abutment, a pivot located along the ridge at the outer perimeter of the planar disk and a handle, said handle rotatable about the pivot, from a stored configuration to an operational configuration, and said abutment at least partially received within the receiver when said handle is in the operational configuration.

2. The lid of claim 1 wherein the ridge at least substantially encircles a perimeter of the disc member.

3. The lid of claim 1 wherein the torquing tool extends radially away from the twisting axis in the operational configuration.

4. The lid of claim 1 wherein the torquing tool rotates about one hundred eighty degrees from the stored configuration to the operational configuration.

5. The lid of claim 1 in combination with a container member having a main body portion with an open end and outwardly directed threads connected to an exterior portion of the main body portion, said outwardly directed threads configured to threadably engage and disengage with the inwardly directed threads of the lid about a twisting axis.

6. The combination of claim 5 further comprising a seal located between the main body portion and the lid, and wherein the seal is gradually deformed when the inwardly and outwardly threads engage to tighten the lid onto the main body portion.

7. The lid of claim 1 wherein the disk member has a planar top surface.

8. The lid of claim 7 wherein the torquing tool further comprises a leg having an upper surface, said leg connected intermediate to the abutment and the handle, said disk member further comprising a slot extending below the planar top surface.

9. The lid of claim 8 wherein the leg of the torquing tool is at least partially received within the slot in the stored configuration.

10. The lid of claim 9 wherein the upper surface of the leg is substantially parallel to and substantially coplanar with the top surface of the disk member in the stored configuration.

11. The lid of claim 1 further comprising a chamber located within the disk member, said chamber extending below the disk member, wherein at least a portion of the handle is located within the chamber in the stored configuration.

12. The lid of claim 11 wherein the chamber is centrally located in the disk member.

13. The lid of claim 11 further comprising a slot located below the disk member, a planar top surface on the disk member, and a leg located intermediate the abutment and the handle on the torquing tool within at least a portion of the leg is received in the slot in the stored configuration.

14. The lid of claim 13 wherein the leg has an upper surface, and the upper surface of the leg is substantially coplanar with the top surface of the disk member in the stored configuration.

15. The lid of claim 14 further comprising a receiver floor wherein the upper surface of the leg contacts the receiver floor when the torquing tool is in the operational configuration.

16. The lid of claim 14 further comprising a well located opposite the chamber from the slot, said well receiving a distal end of the handle.

17. The lid of the claim 16 further comprising a torquing tool axis extending through the torquing tool when the torquing tool is in a stored configuration, and said well, slot and chamber are substantially symmetrical about the torquing tool axis.

18. A lid for use with an open head container, said lid comprising:

a disk member having a top surface;

a ridge extending above and at least substantially around the planar disk;

the ridge having an upwardly extending wall member, a downwardly extending outermost wall connected to the disk member and the ridge, said outermost wall having inwardly directed thread members;

a receiver at least partially located in the ridge; and a torquing tool having an abutment, a pivot, and an abutment wall and a handle, and said upwardly extending wall member and the abutment wall encircle the disk member when the torquing tool is in the stored configuration, and said handle rotatable about the pivot from a stored configuration to an operational configuration, and said abutment at least partially received within the receiver when said handle is in the operational configuration.

* * * * *